US008764107B2

(12) United States Patent
Kusch et al.

(10) Patent No.: US 8,764,107 B2
(45) Date of Patent: Jul. 1, 2014

(54) SEATING FURNITURE

(75) Inventors: Dieter Kusch, Liesen (DE); Robert De Le Roi, Frankenberg (DE); Karl-Heinz Seipp, Allendorf (DE)

(73) Assignee: Kusch + Co. GmbH & Co. KG, Hallenberg (DE)

( * ) Notice: Subject to any disclaimer, the term of this patent is extended or adjusted under 35 U.S.C. 154(b) by 59 days.

(21) Appl. No.: 13/575,706

(22) PCT Filed: Jan. 13, 2011

(86) PCT No.: PCT/EP2011/000123

§ 371 (c)(1), (2), (4) Date: Jul. 27, 2012

(87) PCT Pub. No.: WO2011/091955

PCT Pub. Date: Aug. 4, 2011

(65) Prior Publication Data

US 2012/0299347 A1 Nov. 29, 2012

(30) Foreign Application Priority Data

Jan. 29, 2010 (DE) ..... 10 2010 066 174

(51) Int. Cl.
*A47C 15/00* (2006.01)

(52) U.S. Cl.
USPC ..... 297/248

(58) Field of Classification Search
USPC ..... 297/248
See application file for complete search history.

(56) References Cited

U.S. PATENT DOCUMENTS

| | | | | | |
|---|---|---|---|---|---|
| 3,114,575 | A | * | 12/1963 | Eames et al. | 297/248 |
| 3,226,071 | A | * | 12/1965 | Eames et al. | 297/248 X |
| 3,494,662 | A | * | 2/1970 | Anderson et al. | 297/248 |
| 3,702,204 | A | * | 11/1972 | Tipton et al. | 297/248 |
| 4,277,101 | A | * | 7/1981 | Vogel | 297/248 X |
| 4,790,594 | A | * | 12/1988 | Temos | 297/248 |
| 4,850,159 | A | * | 7/1989 | Conner | 297/248 X |
| 5,129,703 | A | * | 7/1992 | Ballendat et al. | 297/248 |
| 5,470,128 | A | * | 11/1995 | Kerkham | 297/248 X |

(Continued)

FOREIGN PATENT DOCUMENTS

| | | |
|---|---|---|
| DE | 1429358 | 9/1962 |
| DE | 1389255 U1 | 10/1990 |
| EP | 1219208 | 7/2002 |

OTHER PUBLICATIONS

U.S. Appl. No. 13/575,729, *Seating Furniture*, based on PCT/EP2011/000122, filed Jan. 13, 2011.

*Primary Examiner* — Rodney B White
(74) *Attorney, Agent, or Firm* — Kilpatrick Townsend & Stockton LLP

(57) ABSTRACT

The invention relates to seating furniture comprising two frames (2) arranged at a distance to each other on a support (1), between which frames a seat part (3) and a backrest part (4) can be mounted, and the frames (2) have one upper frame part (6) and a lower frame part (7) each which mechanically immobilize the seat part (3) and the backrest part (4) on the edges thereof. The support (1) contains a horizontal bar (11), extending between two legs (5), on which the frames (2) can be mounted as a terminal frame or intermediate frame via respective frame bases (12). The bar (11) comprises a linking piece (13) which is put on a detachable, form-fitting pin connection (14) together with the frame base (12) of a terminal frame and a leg (5) in a certain order.

5 Claims, 3 Drawing Sheets

(56) References Cited

U.S. PATENT DOCUMENTS

Figure 1:
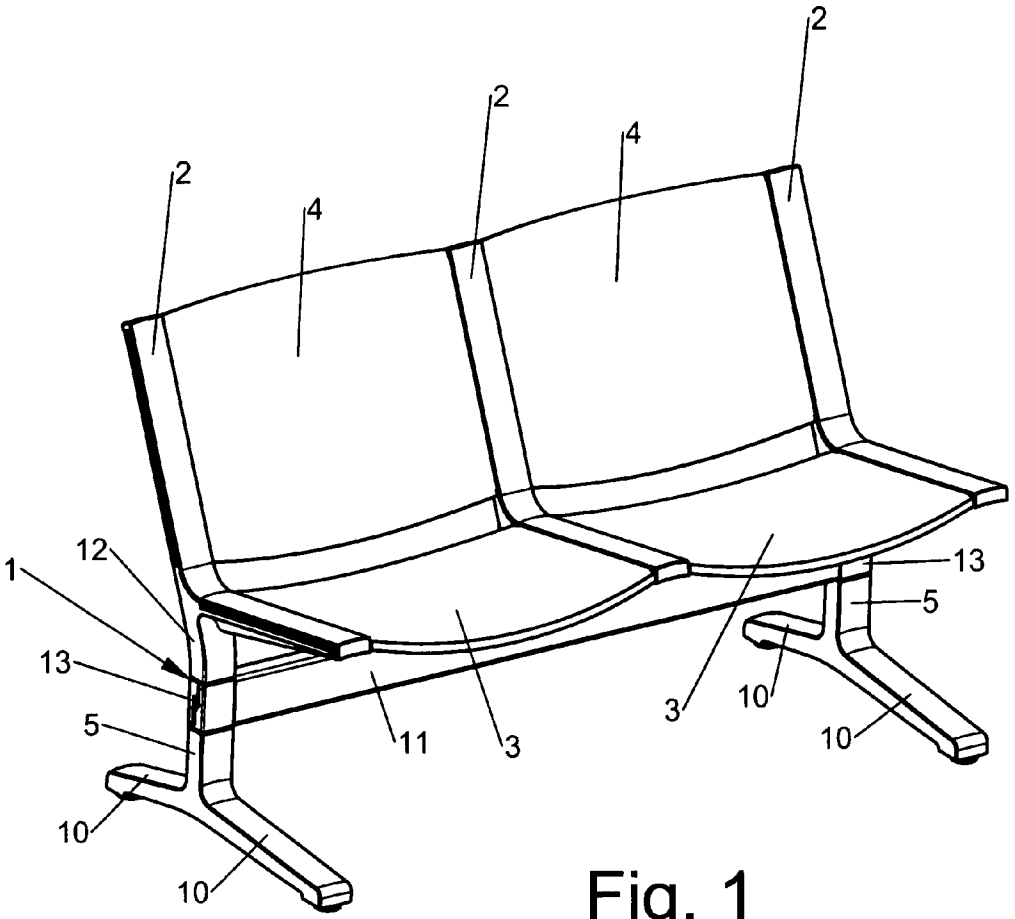

| | | | | |
|---|---|---|---|---|
| 6,095,603 | A * | 8/2000 | Hock | 297/248 X |
| 6,746,086 | B1 * | 6/2004 | Foster | 297/248 X |
| 7,204,553 | B2 * | 4/2007 | Olarte | 297/248 X |
| 7,478,876 | B2 * | 1/2009 | Olarte | 297/248 |
| 7,814,636 | B2 * | 10/2010 | Olarte | 297/248 X |
| 7,845,725 | B1 * | 12/2010 | Sawhney | 297/248 |
| 7,950,739 | B2 * | 5/2011 | King | 297/248 X |
| 2005/0146180 | A1 * | 7/2005 | Fisher et al. | 297/248 |

* cited by examiner

SEATING FURNITURE

The invention relates to seating furniture, in particular a chair or bench, according to the preamble of claim 1.

DE-A 1 429 358 discloses a chair or bench for use as home furniture or seating in public buildings. In the field of public seating, for example waiting rooms, airports, lobbies and the like, the demands placed on seating facilities are exceptionally high. One of the fundamentals is that the seating furniture provides a high level of sitting comfort. Because of the amount of usage and partially also because of the carelessness of the users, such seating furniture rapidly becomes unsightly. Because of the resulting high cost of labor and material for maintenance, the cleaning and replacement have to be made quick and simple.

In order to satisfy these demands, the known seating furniture has a strong, durable frame which can be standardized and thereby minimizes the number of individual components for assembling the seating furniture. The seat and back pads can be removed easily and quickly, since the pads are separate and individual for each seat. Damage to one seat may be repaired by replacement of the particular pad involved simply by its removal and the substitution of a new pad. The pads are identical, irrespective of whether they are utilized for an end seat or for an intermediate seat, where multiple seating is employed. Preferably, separate seat and back pads are used.

Each frame has a pair of cover plates which, in case of the seat portion, forms the top surface of the frame and in the case of the back portion forms the front surface of the frame. The cover plates are removable. The seat pads are suspended between the frames by placing their edge margins between the frames and the cover plates and clamping the cover plates down tightly on them to anchor the pad edges. In addition, the seat and back pads each are provided with grommets in their edge margins for reception of studs. These provide an additional anchor for the seat and back pads and reinforce the clamping formed between the cover plates and the frames.

At the rear end of the seat portion, a socket is provided in the bottom of the frame. The socket is designed to seat about the top flange of a T-shaped horizontal bar of the leg. This provides substantial stability and strength for each of the frames. An end frame is attached to a leg by bolts which extend through the primary frame, suitable openings in the top flange and into a top part of a foot. The intermediate frames, i.e. the footless frames, are attached by threading holes in the top flange of the bar.

The bar also has a vertical flange, which seats firmly in a cross slot in the top part of the foot. By means of bolts, which extend through this vertical flange, the top part of the foot is firmly clamped to the bar. The length of the bar depends on the number of seats going to be joined together to form a multiple seating on a pair of shared legs.

Disadvantageous is the T-shaped bar, which provides a flange connection to an end frame and to the top part of a leg.

The object of the invention is, therefore, to provide a seating furniture according to the preamble of claim 1, which provides a high level of sitting comfort and can be simply assembled and changed.

This object is achieved by the features of claim 1.

As a result, a seating furniture is made which has the advantages of a standardized frame having seat parts and back parts that can be replaced separately, delivers good and durable sitting comfort and at the same time is easy to assemble and to change.

The assembly provided according to the invention uses a vertical arrangement in a row, including a horizontal bar. A compact frame system for a seating furniture is made, ensuring the anchor of the ends of the bar on the legs. At the same time, the overall optical impression of the seating furniture is improved, since the external appearance of the attachment of the frame socket to the bar may be substantially the same for the end frames and the intermediate frames. This results in the optical impression that all of the frame sockets are fitted on the bar and the ends of the bar are supported on the legs. The number of intermediate frames can in this case be chosen, as can be the number of intermediate legs which can be arranged between the legs at the ends.

Further embodiments of the invention will become apparent from the following description and the dependent claims.

The invention is explained in more detail in the following text on the basis of the exemplary embodiments illustrated in the appended drawings.

Figure 2:
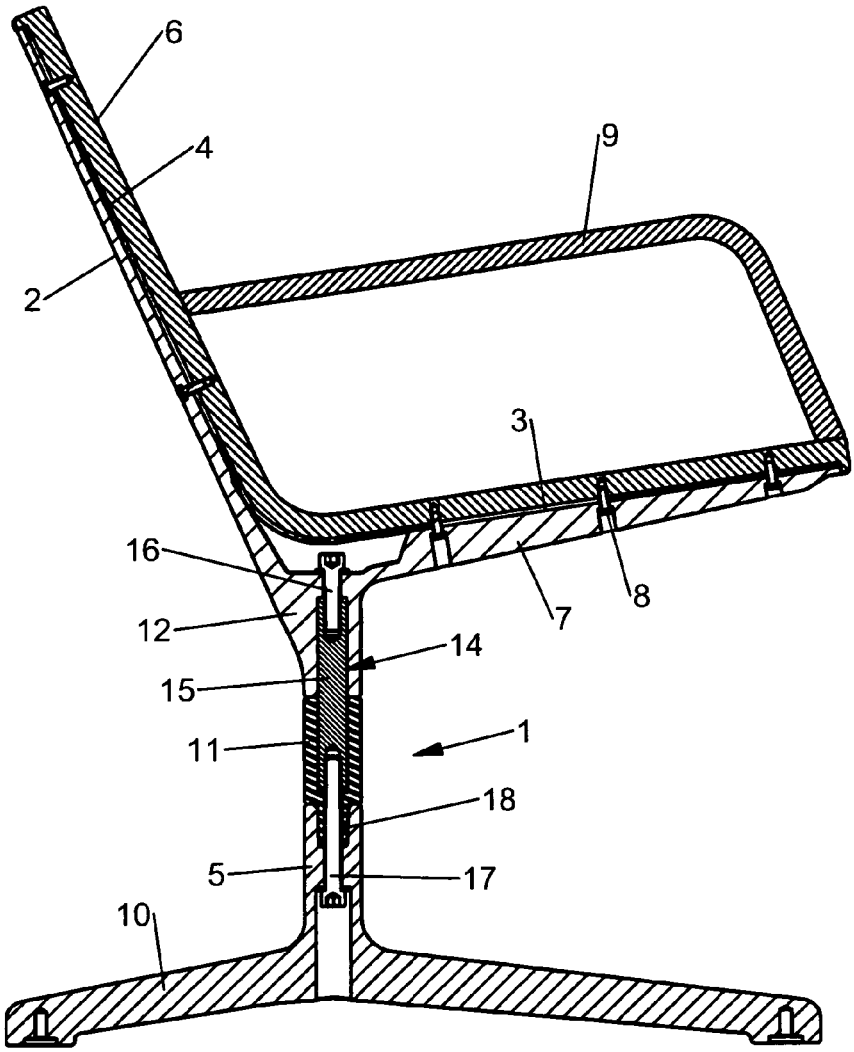
Figure 3:
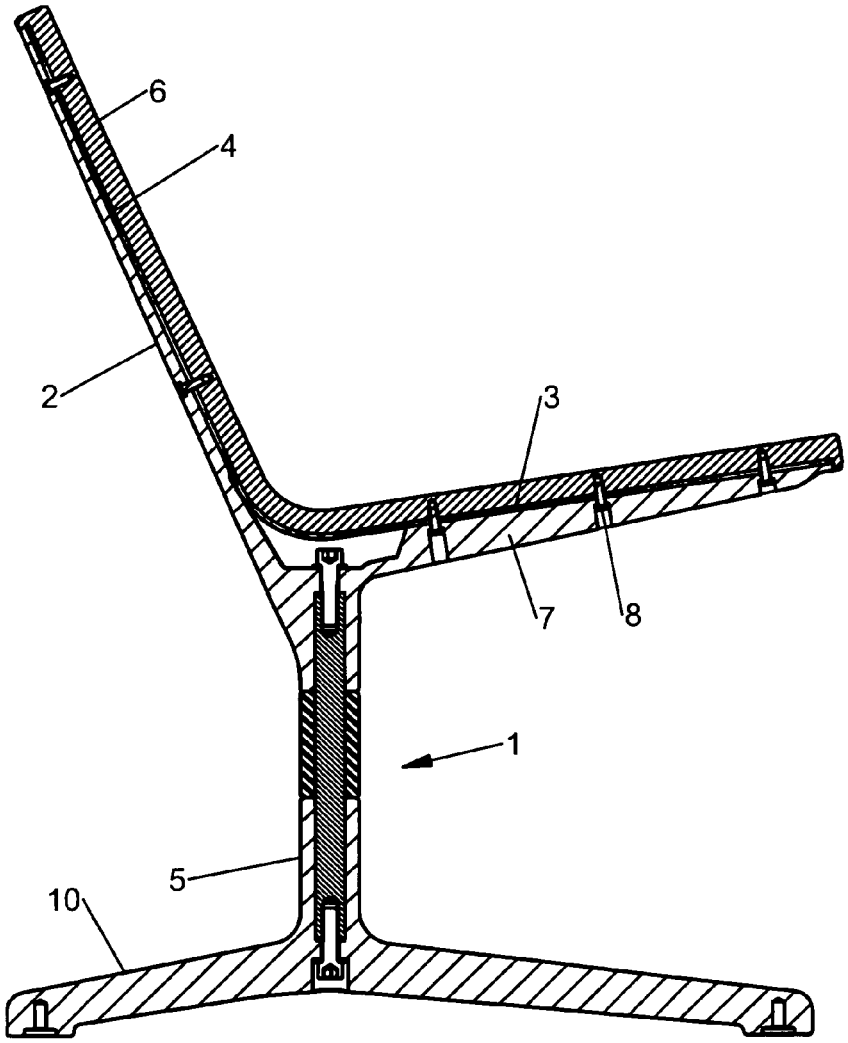

FIG. 1 schematically shows a perspective view of a seating furniture,

FIG. 2 shows a section A-A as per FIG. 1 for a first exemplary embodiment, FIG. 3 shows a section A-A as per FIG. 1 for a second exemplary embodiment.

The seat part 3 and the back part 4 can be formed separately or in one piece/integrally as a seat shell. An armrest 9 can be attached to the top frame part.

As in particular FIG. 2 and FIG. 3 show, the support 1 includes a horizontal bar 11 which extends between two legs 5 and on which the frames 2 can be mounted as end frames or intermediate frames via in each case one frame socket 12.

The bar 11 comprises a linking piece 13 which is arranged in a row with the frame socket 12 of an end frame 2 and with a leg 5, on a detachable, form-fitting pin connection 14. The linking piece 13 is preferably the end-side section of the bar 11, which is supported on the leg 5.

The pin connection 14 has a connecting pin 15 which can be fastened on both sides at the end to the frame socket 12 and the leg 5 by pin screw connections 16, 17 that are oriented in opposite directions.

For an additional frictional connection of the bar 11 in the region of the linking piece 13, the latter has a conical extension 18 on the top side and/or underside (cf. FIG. 2), said extension 18 forming a wedge-type connection having an axial action of force.

The conical extension 18 is preferably a plug-in sleeve, through which one of the pin screw connections 17 can be axially put through.

As the figures show, the invention relates to a seating furniture having at least two frames 2 which are arranged in a manner spaced apart from one another on a support 1 and between which a seat part 3 and a back part 4 can be suspended. The seating furniture is preferably a chair having one seat or a bench having multiple seating successively arranged.

A seating furniture having two seats successively arranged forms a bench. Therefore, a total of three frames 2 are provided, wherein two external frames 2 each form an outer frame and the central frame 2 forms an intermediate frame. All of the frames 2 can be formed in the same manner, as a result of which a standardized frame system is formed. Each seat part 3 and back part 4 is mounted at the periphery and on both sides to a frame 2, in order to form a seat. The number of seats can be chosen. All of the frames 2 of a row of seats can be attached to a common support 1, which is held by a leg 5 having a foot part 10. In the case of more than six seats, preferably at least one intermediate foot (not illustrated) is provided.

A frame 2 comprises in each case a top frame part 6 and a bottom frame part 7 which mechanically fix the seat part 3 and the back part 4 at the periphery. Therefore, the top frame part

6 and the bottom frame part 7 are preferably braceable clamping members. In order to brace the top frame part 6 and the bottom frame part 7, there are preferably provided clamp bolts 8, which are put through the bottom frame part 7 and can be screwable into the top frame part 6.

The top frame part 6 and the bottom frame part 7 are preferably both L-shaped clamping members, which connect a seat part 3 and a back part 4 of a frame 2 together in one piece.

The invention claimed is:

1. Seating furniture, comprising at least two frames which are arranged at a distance to each other on a support and between which a seat part and a back part can be suspended, and the frames each have a top frame part and a bottom frame part which mechanically fix the seat part and the back part, and further comprising a horizontal bar extending between two legs and on which the frames can be mounted as an end frame or intermediate frame via respective frame sockets, wherein the bar comprises a linking piece which is aligned with the frame socket of an end frame and with a leg, on a detachable, form-fitting pin connection, and wherein a number of frames are mounted spaced apart to the bar.

2. Seating furniture as claimed in claim 1, wherein the pin connection has a connecting pin which can be fastened to the frame socket and the leg by pin screw connections that are oriented in opposite directions.

3. Seating furniture as claimed in claim 2, wherein, for an additional frictional connection, the bar has a conical extension on a top side and/or underside in a region of the linking piece, said extension forming a wedge-type connection having an axial action of force.

4. Seating furniture as claimed in claim 3, wherein the conical extension is a plug-in sleeve, through which one of the pin screw connections can be axially put through.

5. Seating furniture as claimed in claim 1, wherein the top frame part is formed in one piece in order to mount the seat part and back part.

* * * * *